US007156745B1

(12) United States Patent
Fahmie

(10) Patent No.: US 7,156,745 B1
(45) Date of Patent: Jan. 2, 2007

(54) COMBINATION POOL TABLE/PING PONG TABLE

(76) Inventor: Richard B. Fahmie, 4731 Greenbrier Ave., San Diego, CA (US) 92120

( * ) Notice: Subject to any disclaimer, the term of this patent is extended or adjusted under 35 U.S.C. 154(b) by 0 days.

(21) Appl. No.: 10/960,558

(22) Filed: Oct. 7, 2004

(51) Int. Cl.
*A63D 15/04* (2006.01)
*A63D 13/00* (2006.01)
*A63D 15/00* (2006.01)

(52) U.S. Cl. ..... 473/10; 473/14; 273/309; 108/13

(58) Field of Classification Search ..... 473/2–16; 108/144.11, 7, 50.01, 150, 147, 106; 248/188.1, 248/188.8; 273/309
See application file for complete search history.

(56) References Cited

U.S. PATENT DOCUMENTS

| | | | | |
|---|---|---|---|---|
| 1,540,316 | A * | 6/1925 | Clement | 473/11 |
| 1,943,280 | A * | 1/1934 | Arnold | 108/147 |
| 2,115,115 | A * | 4/1938 | Matteson et al. | 473/14 |
| 3,743,287 | A * | 7/1973 | Liermann | 473/12 |
| 3,858,877 | A * | 1/1975 | Lundstrom | 473/14 |
| 4,301,745 | A * | 11/1981 | Dale | 108/144.11 |
| 4,345,758 | A * | 8/1982 | Kempf | 473/475 |
| 4,722,530 | A * | 2/1988 | Hendon | 273/309 |
| 4,927,140 | A * | 5/1990 | Pappas | 473/8 |
| 6,082,736 | A * | 7/2000 | Barlow | 273/317.1 |
| 6,102,808 | A * | 8/2000 | Wong | 473/12 |
| 6,502,819 | B1 * | 1/2003 | Rieber et al. | 273/126 R |
| 6,709,341 | B1 * | 3/2004 | Giles | 473/4 |
| 6,764,409 | B1 * | 7/2004 | Voden | 473/10 |
| 2005/0049056 | A1 * | 3/2005 | Padilla | 473/10 |
| 2005/0107177 | A1 * | 5/2005 | Arias | 473/10 |
| 2005/0255928 | A1 * | 11/2005 | Nally | 473/10 |

FOREIGN PATENT DOCUMENTS

| | | | | |
|---|---|---|---|---|
| CA | 744276 | A * | 10/1966 | 473/30 |

* cited by examiner

*Primary Examiner*—Mitra Aryanpour
(74) *Attorney, Agent, or Firm*—Charles C. Logan, II

(57) ABSTRACT

A combination pool table/ping pong table having height adjustment means for raising and lowering simultaneously the four corners of the game table. This allows the game of pool to be played at a proper regulation height and also allows the ping pong table to be used at a proper regulation height. A ping pong table surface is formed from a plurality of panels that rest on the top edge of the game table. These panels can be removably connected to each other. There is a storage rack assembly positioned in a chamber beneath the playing surface of the pool table that allows the ping pong table panels to be stored out of sight when not in use. There are two different embodiments of height adjustment means for raising and lowering the height of the game table.

8 Claims, 12 Drawing Sheets

COMBINATION POOL TABLE/PING PONG TABLE

BACKGROUND OF THE INVENTION

The invention relates to a pool table and more specifically to one that can function as a ping pong table by placing one or more table panels on the top surface of the side walls of the pool table. The height of the pool table is also adjustable so that it may be at a proper height for playing pool and also the proper for height for playing ping pong. Multi purpose pool tables and pool tables having an adjustable height are known in the prior art. Some of these will be discussed below.

The Matteson et al U.S. Pat. No. 2,115,115 is directed to a billiard table that can be built with standard parts and which can be assembled upon delivery without the necessity of skilled or technical workmen. It also discloses the use of a removable top whereby a billiard table can be adapted for other games, such as table tennis.

The Hopper U.S. Pat. No. 2,818,256 is directed to a game table having collapsible leg assemblies. The height of the table can be adjusted by changing the position of the free end of the braces 7 in one of the rows of pegs 9 fixed to the bottom of frame 1.

The Liermann U.S. Pat. No. 3,743,287 discloses a pool table having fold-up legs and the table normally fits in an overhead rectangular frame fastened to the ceiling of a room. A legless ping pong table rests on top of the pool table and it can be lifted up into the frame by means of the cables whenever it is desired to play pool on the pool table.

The Grover U.S. Pat. No. 3,988,021 discloses a pool table that may be raised and lowered along the X-axis by extending and retracting the adjusting rod 50. Also rotation of sleeve 72 will shorten or lengthen the braces to level the table along the X-axis.

The Dale U.S. Pat. No. 4,301,745 discloses a table that has a table top the height of which can be adjusted between an elevated position and a lower position so that the table can be used, for example as both a billiards table and as a domestic dining table. Adjustment of the height of the table top is affected with a mechanism, incorporating a support member which can be moved from a retracted position into an extended position in which it acts to support the elevated table top on a support structure. This movement of the support member is affected on lifting of the table top by engagement of a cam follower with a cam surface. Lifting of the table top beyond the elevated position may act to return the support member to its retracted position via engagement of a further cam follower with a further cam surface.

The Van And a U.S. Pat. No. 4,907,803 relates to a game board and more particularly to ping pong tables which can be elevated for play and deactivated to prevent unauthorized play. A pair of compressed air cylinders 25 are provided disposed in spaced relation in the base along the length of the table to provide a more stable activation and support means for the game playing surface 11. The pairs of cylinders are secured approximately the opposite edge 27 of the table surface from the hinge connection with the base. The cylinders have a predetermined extension length whereby when they extend to the selected length the game playing surface will be disposed level on the base.

The Pappas U.S. Pat. No. 4,927,140 has a recto-linear bed with a playing surface adapted to the game of billiards. Four circumferential rails are moveable from a first, second or third position. In the first position, pockets are formed at the corners of the playing surface and at the centers of two edges thereof, whereby the game of pocket billiards can be played. In the second position the notches in the bed for forming the pockets are covered, whereby the game of carom may be played. In the third position, in which the rails are elevated, air panels may be laid on the bed, whereby the game of air hockey can be played. Another feature of the table is a wheel carriage 80 which is used to raise and lower the wheel's 81 with a pneumatic jack 82 or, alternatively with a screw jack.

The Barlow U.S. Pat. No. 6,082,736 discloses a multi-purpose game assembly which includes a table tennis assembly, a billiards assembly, a basketball assembly and a hockey assembly.

The Wong U.S. Pat. No. 6,102,808 discloses a height-adjustable billiard table. A table body 1 is supported and secured by the support screw rods 21 at the four corners thereof. Turning handle 34, the height of the table body can be adjusted to displace upwardly and downwardly the height suitable for the user while maintaining the level of the table body.

The Reiber et al U.S. Pat. No. 6,502,819 discloses a convertible game table which can be used to play a SKEE-BALL type game, a rebound hockey or shuffle board game and pool or billiards utilizing different-size playing areas spaced at different elevations above the floor. Column 3, lines 26–36 describes how the height of the table is adjusted upwardly and downwardly.

It is an object of the invention to provide a novel combination pool table/ping pong table that has a storage area for the leafs or panels of the pool table.

It is also an object of the invention to provide a novel combination pool table/ping pong table that can double as an extra dining room table.

It is another object of the invention to provide a novel combination pool table/ping pong table that can be raise and lower all four corners of the pool table simultaneously.

SUMMARY OF INVENTION

The combination pool table/ping pong table has a storage rack assembly is attached to the bottom surface of the rigid table panel sub-frame pool game playing support assembly. One of the side walls of the furniture frame of the game table has a door that hinges downwardly to provide access to the storage rack assembly. The ping pong table, which would be comprised of two panels connected end to end, would be stored out of sight in the storage rack assembly. Felt spacer blocks would be positioned beneath the ping pong table panels to provide a rigid support for the ping pong table.

The novel game table is a combination pool table/ping pong table. The regulation height of a pool table is approximately 2 inches higher than the regulation height of a ping pong table. In order to have the same game table properly function as both a pool table and a ping pong table it has been necessary to design a mechanism for raising and lowering the vertical height of the pool table. This capability of being able to raise and lower the height of the pool table can also be taken advantage of when children that are smaller than adults use the pool table or ping pong table. The ping pong table setup can also double as an extra dining room table.

The novel chain and sprocket height adjustment assembly that is utilized is mounted on a major horizontal plate member supported by the primary support assembly. Four vertically oriented rod members have their bottom ends journaled and supported on the horizontal major plate member adjacent the four corners of the major plate. Sprocket gears are mounted on the bottom ends of the respective rod members and their top ends are externally threaded. Connected to the bottom surface of the rigid table panel sub-frame support assembly are four cylindrical tubular members having a plug member having a threaded bore hole closing their bottom end. The top ends of the respective rod members are threaded in these threaded bore holes.

A box frame has upright side walls that extend upwardly from the major plate member. A transmission shaft is journaled in the front end of the box member. A wheel is mounted on the front end of the transmission shaft and a handle extends outwardly from the front end of the wheel member. The rear end of the transmission shaft is connected to a gear transmission assembly having a primary sprocket gear mounted on a vertical shaft. A closed loop chain passes around the four sprocket gears and the primary sprocket gear. Rotation of the wheel by its handle causes the respective sprocket members and rod members to simultaneously rotate which raises and lowers the furniture frame of the pool table.

An alternative embodiment of the combination pool table/ping pong table has a primary support assembly having a plurality of front legs and a plurality of rear legs. Lifting blocks having a predetermined height would be inserted below the heel of these respective legs when the game table is to function as a pool table. When these lifting blocks are removed, the game table returns to its function as a ping pong table. A unique pry bar and/or a standardized jack can be utilized to lift one end of the game table at a time in order to position the lifting blocks under the heels of the leg members.

DESCRIPTION OF THE PREFERRED EMBODIMENT

Figure 1:
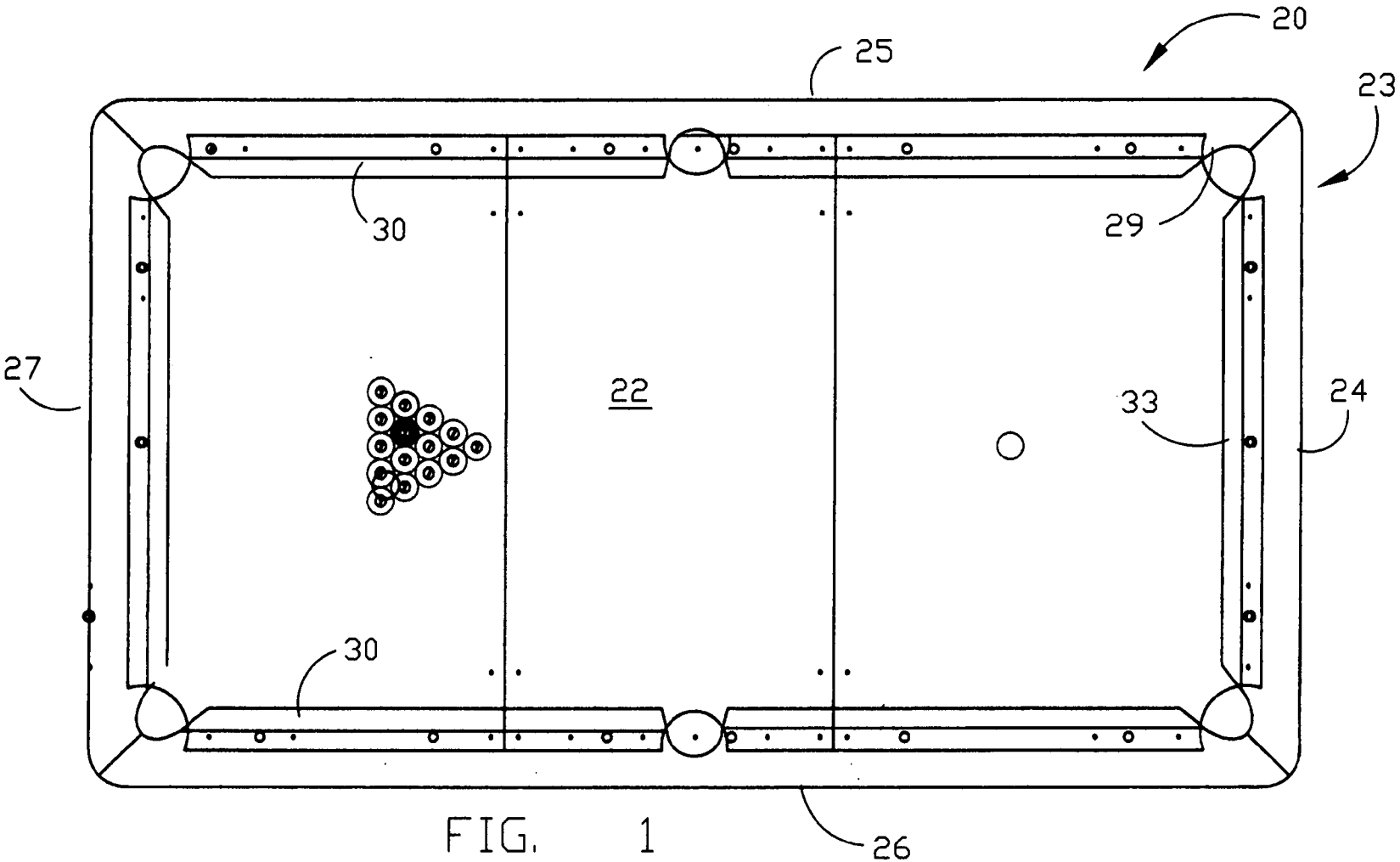
FIG. 1 is a top plan view of the game table when utilized as a pool table.
Figure 2:
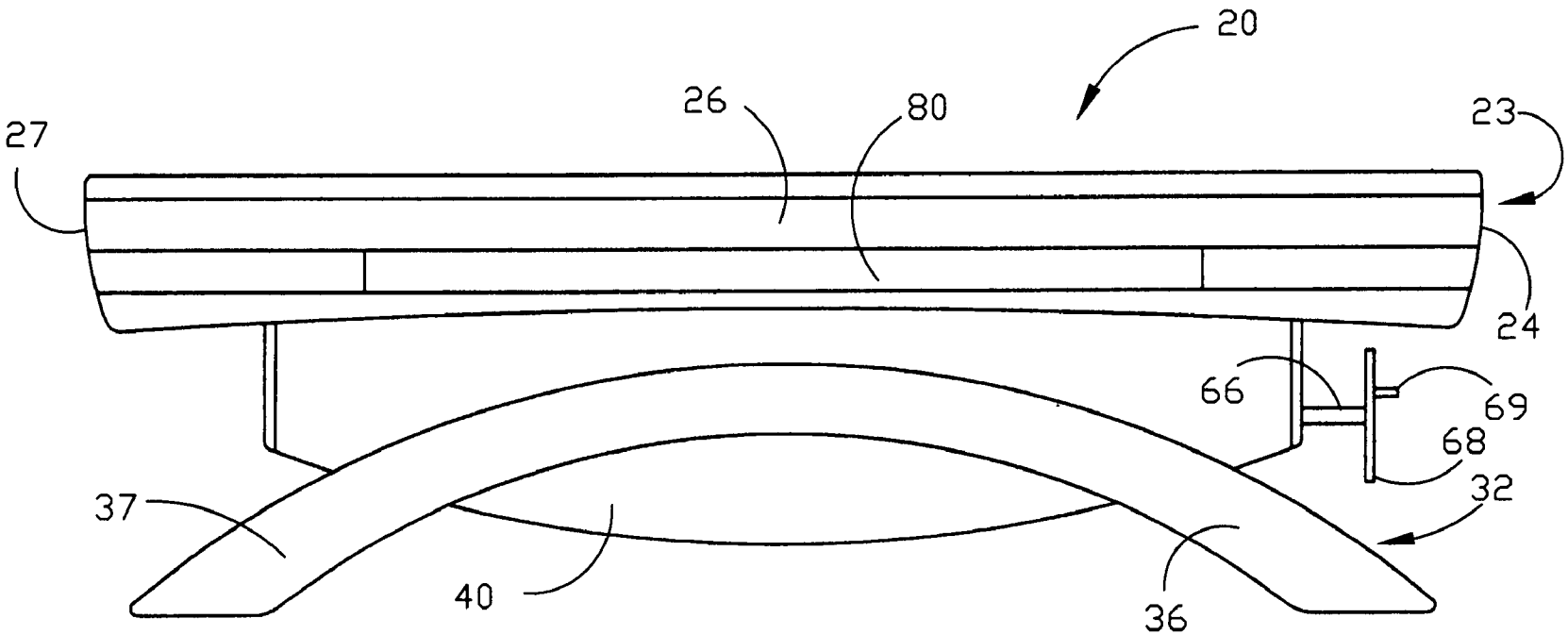
FIG. 2 is a right side elevation view thereof.
Figure 3:
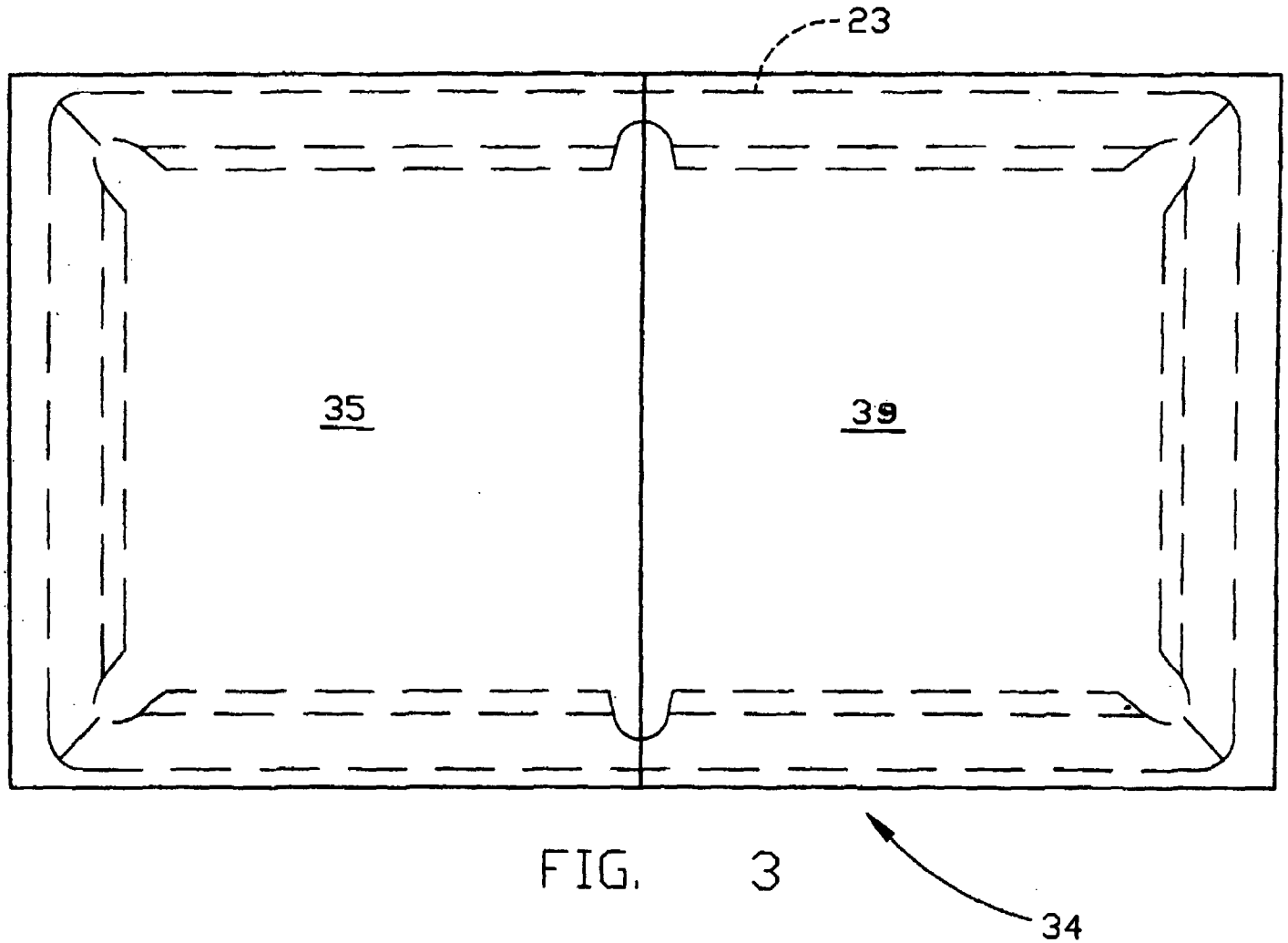
FIG. 3 is a top plan view of the game table when utilized as a ping pong table.
Figure 4:
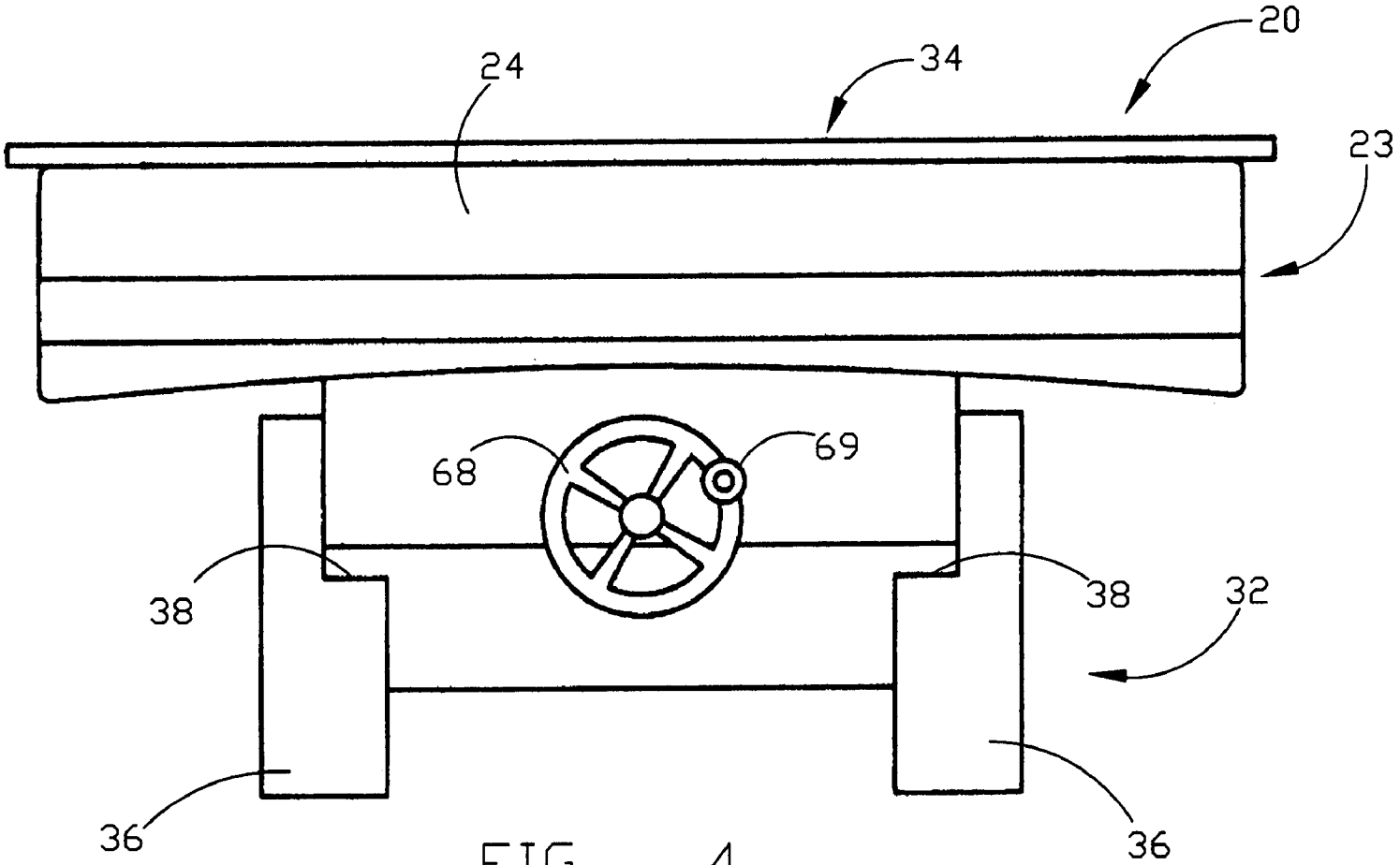
FIG. 4 is a front elevation view thereof.
Figure 5:
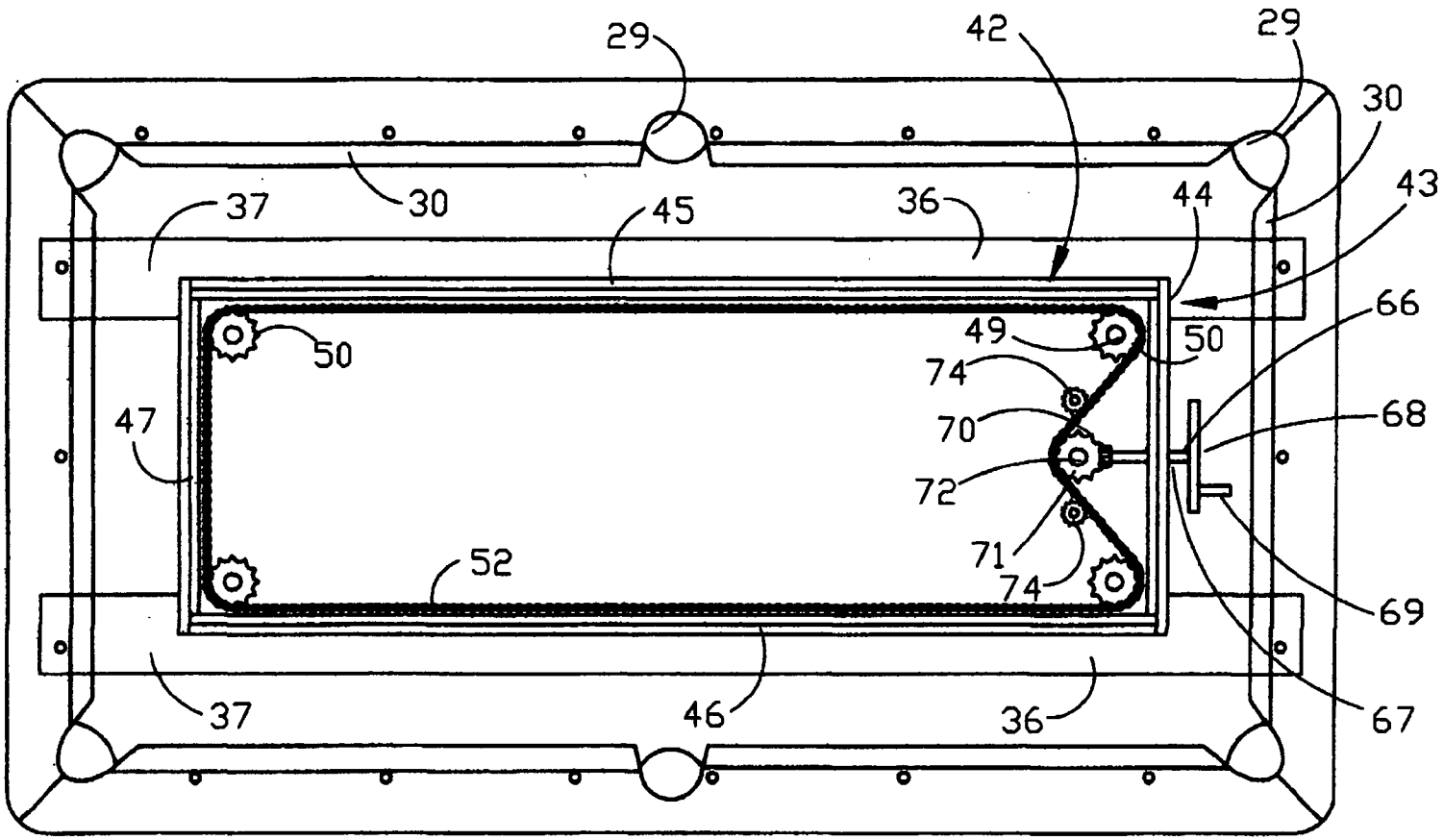
FIG. 5 is a schematic top plan view of the game table when utilized as a pool table.

The combination pool table/ping pong table will now be described by referring to FIGS. 1–8 of the drawings. The combination game table is generally designated numeral 20. FIG. 1 shows the table panel 22 that would be covered by a layer of felt fabric (not shown) and this would be the playing surface of the pool table. Table panel 22 provides the support structure for the surrounding cosmetic furniture frame 23 that has a front end wall 24, a left side wall 25, a right side wall 26 and a rear end wall 27. Pockets 29 are located around the edge of the playing surface. Bumper rails 30 extend between the respective pockets. FIG. 2 is a right side elevation view of FIG. 1 and it shows the primary support assembly 32. FIG. 3 is a top plan view of the game table 20 showing the ping pong table 34 mounted thereon. It is assembled from panels 35 and 39 that are connected together along one of their side edges.

Primary support assembly 32 has a pair of front legs 36 and a pair of rear legs 37. As illustrated in the drawings, there are two laterally spaced leg assemblies and each includes a front leg 36 and a rear leg 37. Each of the leg assemblies has a shoulder 38 that provides a support structure for elongated beams 40.

FIGS. 5–8 clearly illustrate the chain and sprocket height adjustment assembly 42. It has a box frame 43 having a front wall 44, a left side wall 45, a right side wall 46 and a rear end wall 47. A metal major plate 48 forms the bottom of box frame 43 and its lateral sides are supported on the respective shoulders 38 of legs 36 and 37. Four upright oriented rod members 49 have their bottom ends journaled in major plate 48. A sprocket gear 50 is mounted adjacent the bottom ends of rod members 49. The top end of rod members 49 are externally threaded. A closed loop chain 52 passes around the outer edge of the respective sprocket gears 50.

Table panel 22 is preferably a slab of slate. It is supported in a table panel frame 54 whose lateral edges are received in recesses on the inside of the walls of furniture frame 23. The interior of furniture frame 23 beneath table panel frame 54 forms a major chamber 56. Table panel frame 54 is supported on the top surface of a rigid table panel sub-frame support assembly 58. This provides a rigid support for table panel 22.

Four metal minor plates 60 are secured to the bottom surface of sub-frame support assembly 58. Four cylindrical tubular members 61 have their top end secured to minor plates 60. A plug member 62 having a threaded bore hole 63 is fixedly secured in the bottom end of cylindrical tubular member 61. The interior of cylindrical tubular members 61 forms minor chambers 64. The top end of rod members 49 are threaded into the respective threaded bore holes 63. A transmission shaft 66 is journaled in a bearing 67 in front wall 44. A wheel 68 is mounted on the front end of transmission shaft 66 and a crank or handle 69 is secured thereto. A gear transmission assembly 70 is secured to the rear end of transmission shaft 66. It has a primary sprocket gear 71 mounted on a shaft 72. Primary sprocket gear 71 engages chain 52. A pair of idler gears 74 also engage chain 52. Rotation of wheel 68 causes the furniture frame 23 to be raised or lowered between the pool playing position and the ping pong playing position. A ping pong table storage rack assembly 76 is mounted under the bottom surface of sub-frame support assembly 58. It has a plurality of channel shaped cross members 77 that support the respective ping pong table panels 35 and 36.

Figure 6:
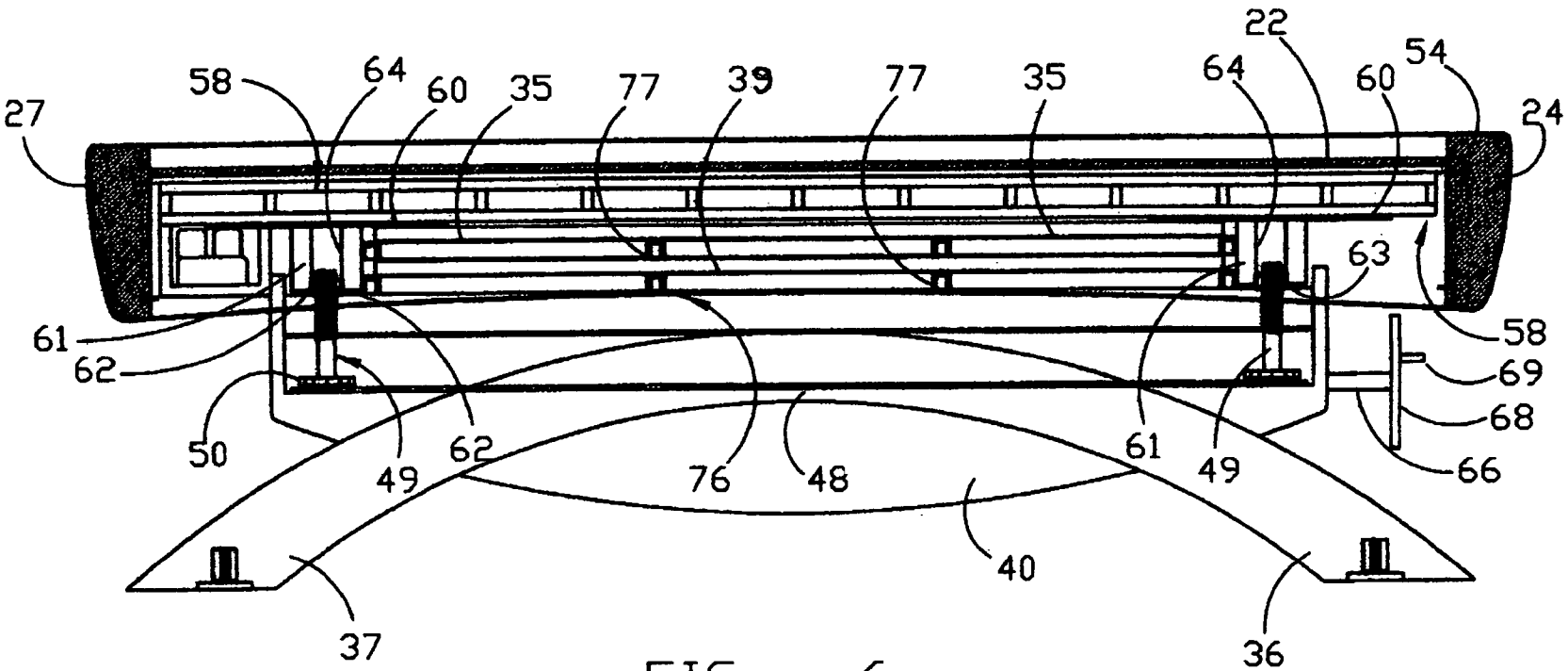
FIG. 6 is a schematic vertical cross section of FIG. 5 when used as a pool table.
Figure 7:
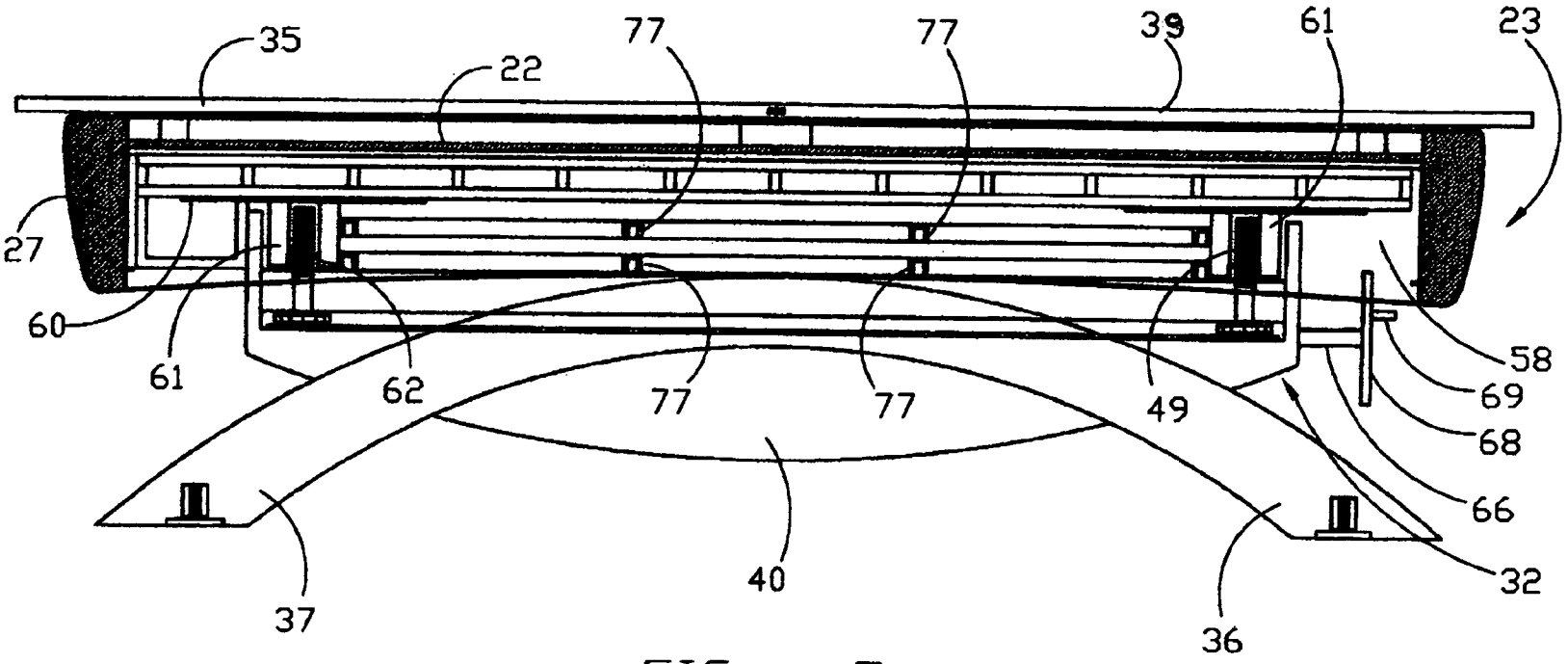
FIG. 7 is a schematic vertical cross section view of FIG. 5 when used as a ping pong table.
Figure 8:
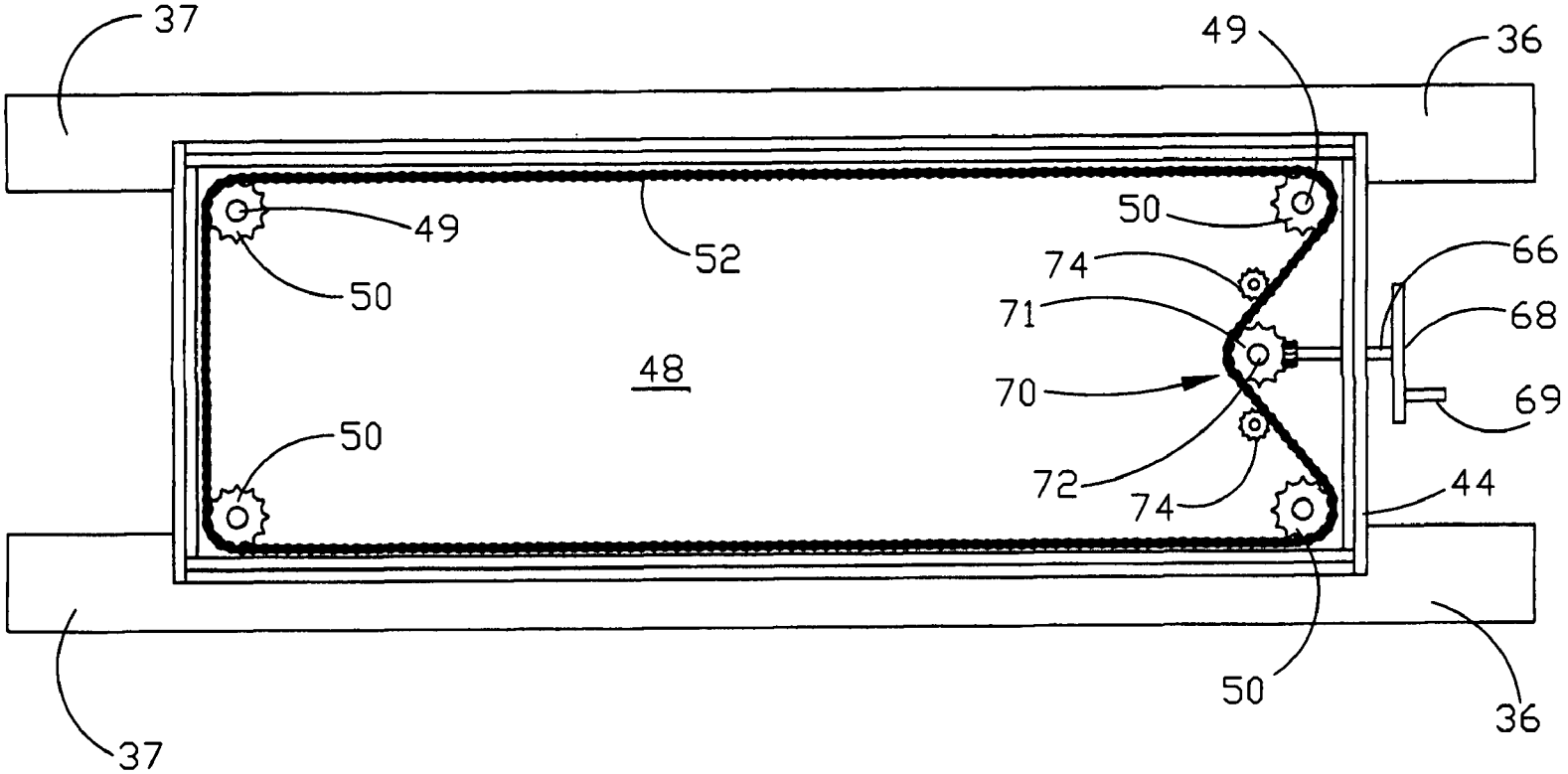
FIG. 8 is a schematic top plan view of the chain and sprocket height adjustment assembly mounted on the primary support assembly.
Figure 13:
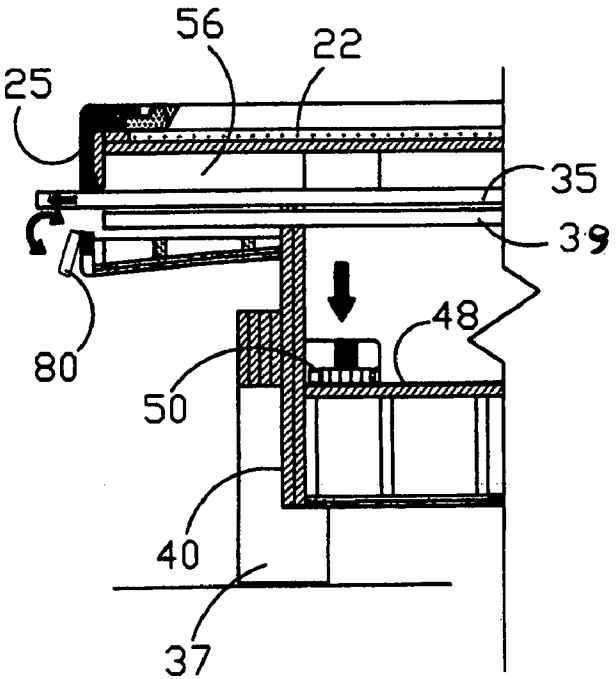
FIG. 13 is a schematic partial end elevation view showing the door panel open for removing the ping pong table leafs being removed from their storage area
Figure 12:
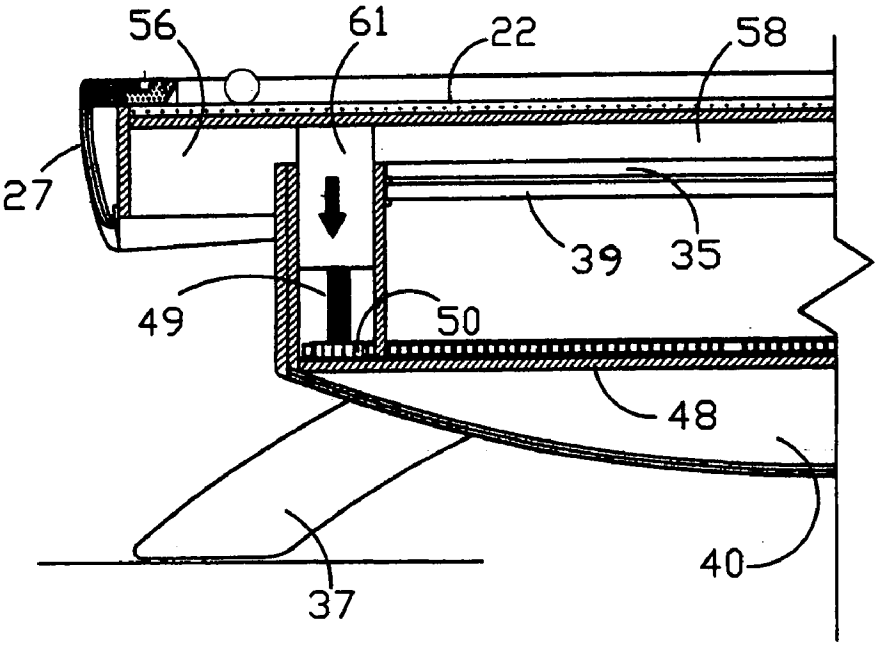
FIG. 12 is a schematic partial side elevation view of the game table showing the ping pong table leafs stored under the game table.

FIG. 12 is an enlarged view of the left end of FIG. 6. FIG. 13 is a schematic partial vertical cross section taken through right side wall of furniture frame 23. It shows a door panel 80 that is hinged to open and close to allow access to the respective panels 35 and 39 of the ping pong table 34.

Figure 9:
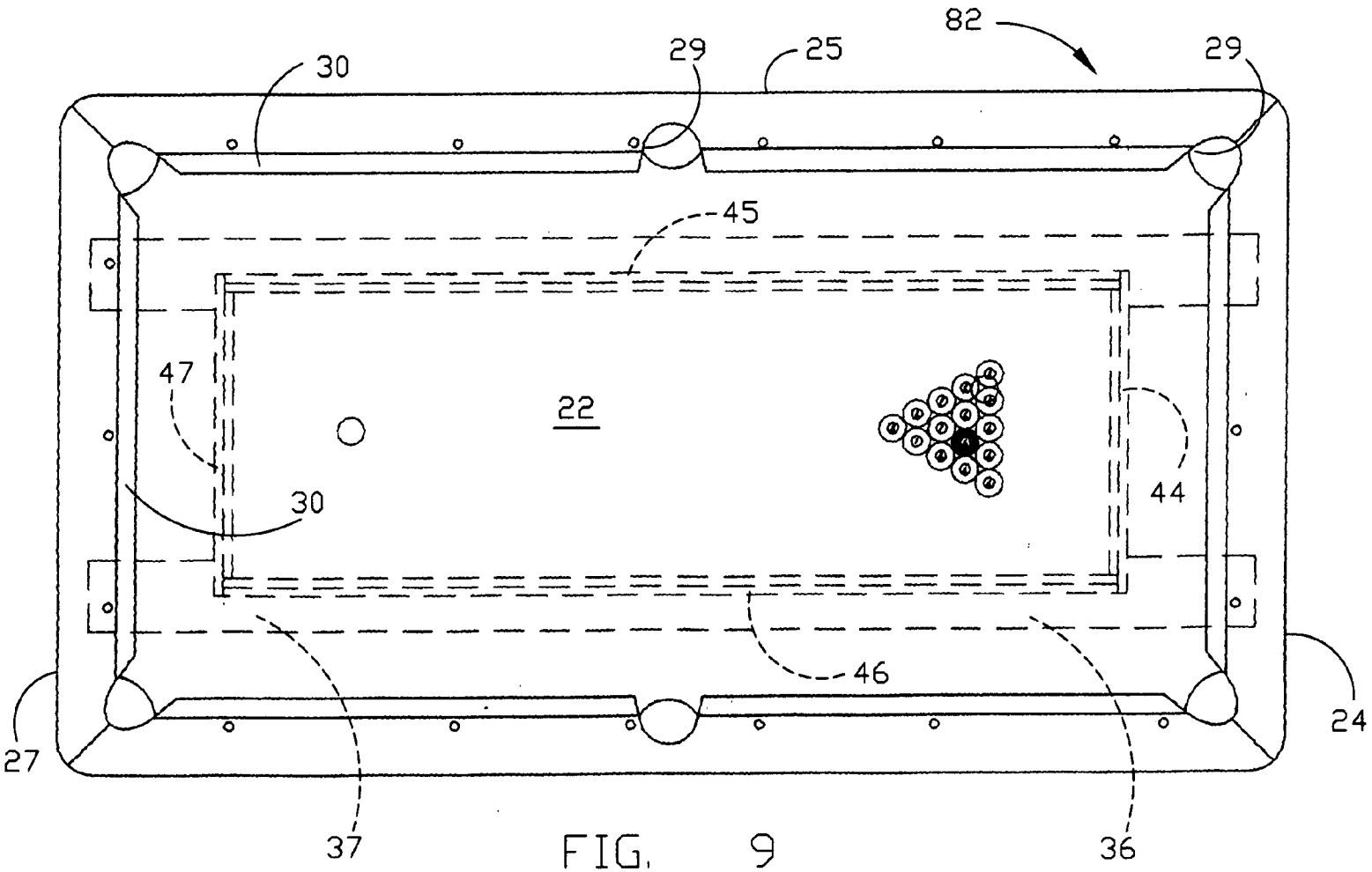
FIG. 9 is a top plan view of a first alternative embodiment of the game table when used as a pool table.
Figure 10:
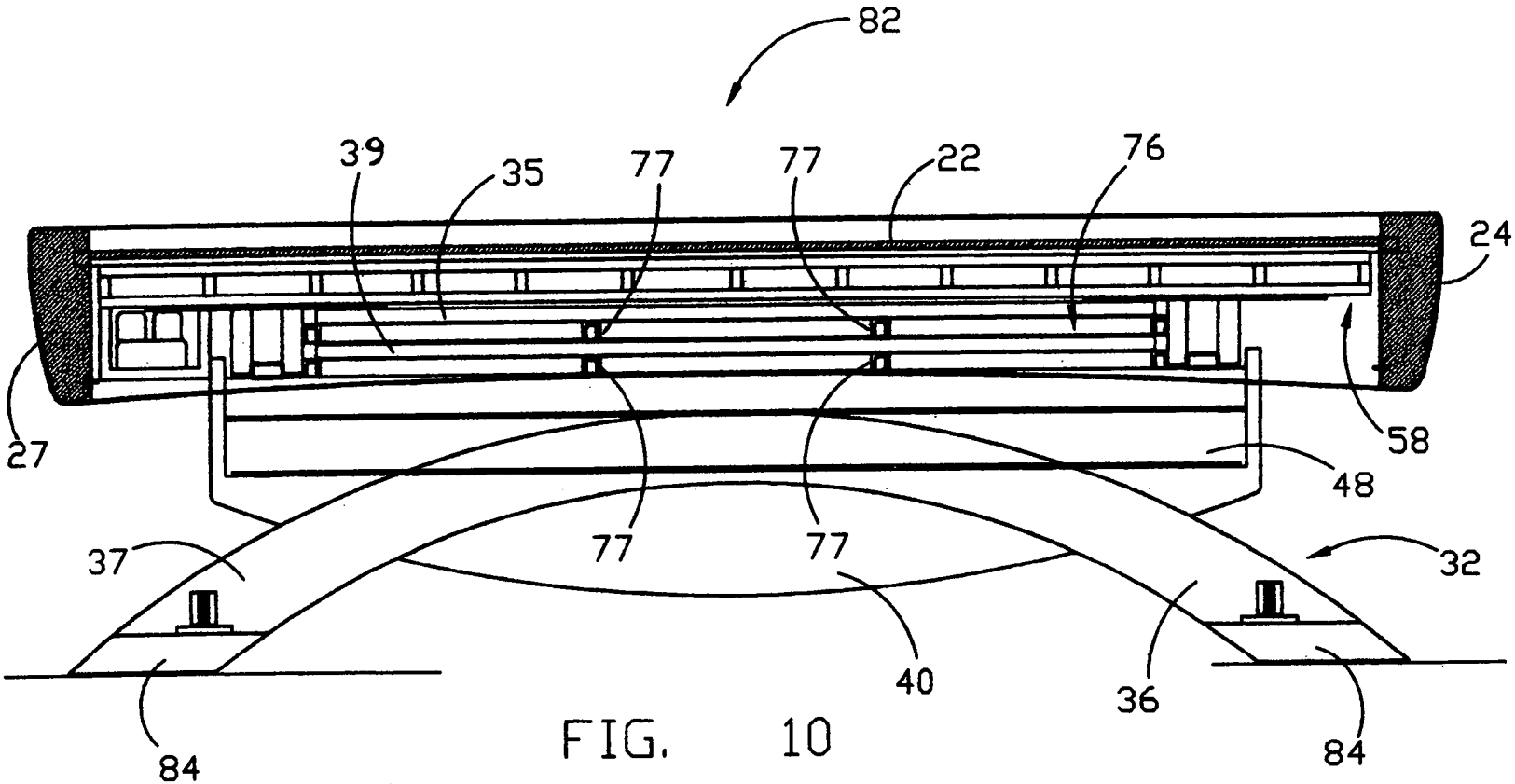
FIG. 10 is a schematic cross sectional view of FIG. 9 when used as a pool table.
Figure 11:
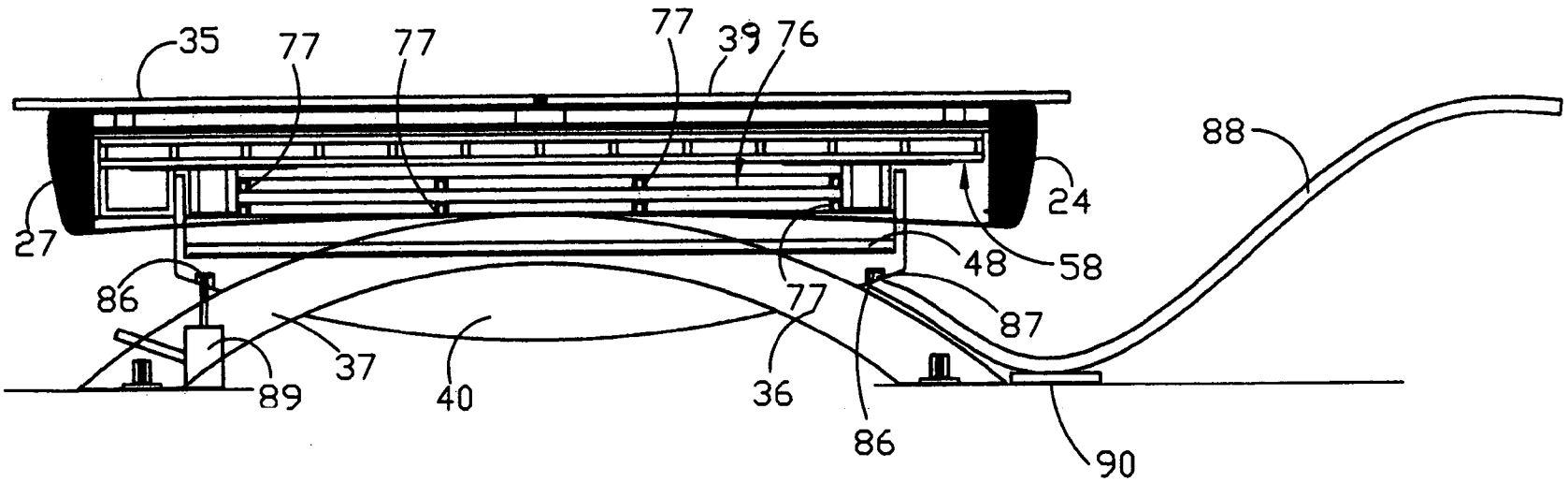
FIG. 11 is a schematic cross sectional view of FIG. 9 when used as a ping pong table.

A first alternative embodiment game table 82 is illustrated in FIGS. 9–11. Similar structure in this embodiment is given the same numeral designation previously rendered in the original embodiment described. Front legs 36 and 37 each have a bottom heel. Spacer block 84 can be placed under these respective heels to raise the height of the game table when it is to be used as a pool table. Recesses 86 are formed in the bottom surface of the respective beams 40 for receiving a protrusion 87 on the rear end of a serpentine shaped pry bar 88. A jack 89 could also be used. By using the pry bar or a standard jack first at one end and then at the other end of the game table, it may be raised a sufficient height to install or remove the respective spacer blocks 84. The metal pry bar is pivoted about the top surface of a support pad 90.

What is claimed is:

1. A combination pool table/ping pong table comprising:

a substantially rectangularly-shaped table panel having four corners, a top playing surface, a front edge, a rear edge, a left edge, a right edge, a bottom surface and a longitudinally extending axis; said table panel being horizontally oriented so that a game of pool can be played on said top surface, pockets are located around said edges of said top playing surface at predetermined positions; bumper rails extend between said respective pockets;

a cosmetic furniture frame connected to and surrounding said table panel; said furniture frame having upright oriented left and right side walls, an upright oriented front wall and an upright oriented rear wall; said respective walls each having a bottom edge; said respective left and right side walls and said front and rear walls defining a major chamber below said bottom surface of said table panel that extends down to said respective bottom edges of said respective walls;

a horizontally oriented rigid sub-frame support assembly having a top surface, a bottom surface, a front end, a rear end, a left edge and a right edge; said substantially rectangularly-shaped table panel being supported on said top surface of said rigid sub-frame support assembly to prevent said table panel from drooping in its central area;

support means for said table panel comprising front and rear support legs;

chain and sprocket height adjustment means for raising and lowering simultaneously said four corners of said table panel vertically with respect to said support means; said chain and sprocket height adjustment means being mounted on said support legs; and a storage rack assembly for a plurality of panels that form a ping pong table when placed and assembled on top of said furniture flame; said storage rack assembly being mounted beneath said bottom surface of said table panel in said major chamber.

2. A combination pool table/ping pong table as recited in claim 1 wherein one of said side walls of said furniture frame has a door that can be opened and closed to provide access to said storage rack assembly and allow the panels that form a ping pong table to be easily accessed and stored.

3. A combination pool table/ping pong table as recited in claim 1 further comprising a plurality of panels assembled together to form a ping pong table and positioned onto said furniture frame.

4. A combination pool table/ping pong table as recited in claim 1 wherein said table panel is a slab of slate.

5. A combination pool table/ping pong table as recited in claim 1 further comprising a metal major plate having a top surface and at least four corners; said metal major plate extending between said front and rear support legs; and said chain and sprocket height adjustment means is mounted on said metal major plate; said chain and sprocket height adjustment means comprises a vertically oriented screw jack assembly mounted adjacent each of said corners on said metal major plate.

6. A combination pool table/ping pong table as recited in claim 5 wherein each of said screw jack assemblies have a vertically oriented rod member having a top end and a bottom end; said top end is externally threaded and said bottom end is journaled on said metal major plate; a sprocket gear is mounted on said rod members adjacent said bottom ends; a closed loop chain passes around all of said sprocket gears so that they rotate simultaneously in unison.

7. A combination pool table/ping pong table as recited in claim 6 further comprising at least four vertically oriented tubular members each having a top end, an internal minor chamber and a bottom end; a plug member having a threaded bore hole is rigidly secured in said minor chamber adjacent said bottom end; said top ends of said tubular members are rigidly secured to said bottom surface of said rigid table panel sub-frame support assembly; and said externally threaded top ends of said rod members are threaded into said respective threaded bore holes.

8. A combination pool table/ping pong table as recited in claim 7 further comprising a vertically oriented wheel having a front surface and a rear surface; a handle is connected to said front surface and the front end of a transmission shaft is connected to said rear surface; the rear end of said transmission shaft is connected to a gear transmission assembly that engages said closed loop chain thereby allowing rotation of said wheel to raise and lower the height of said table panel.

* * * * *